United States Patent [19]

Jung et al.

[11] Patent Number: 5,048,976

[45] Date of Patent: Sep. 17, 1991

[54] CARRIER BAG

[75] Inventors: Ralf Jung, Forchheim; Martin Schledorn, Kirchehrenbach; Thomas Schnabel, Forchheim; Günter Schulz, Forchheim; Kurt Springer, Forchheim; Adalbert Süss, Forcheim, all of Fed. Rep. of Germany

[73] Assignee: Unilever Patent Holdings B.V., Rotterdam, Fed. Rep. of Germany

[21] Appl. No.: 349,665

[22] Filed: May 10, 1989

[30] Foreign Application Priority Data

May 10, 1989 [DE] Fed. Rep. of Germany ..... 3815881

[51] Int. Cl.[5] ..... B65D 33/06

[52] U.S. Cl. ..... 383/10; 383/20

[58] Field of Search ..... 383/10, 17, 20

[56] References Cited

U.S. PATENT DOCUMENTS

| | | | |
|---|---|---|---|
| 3,208,492 | 9/1965 | Braithwaite | 383/20 |
| 3,255,951 | 6/1966 | Kay | 383/10 |
| 3,514,033 | 5/1970 | Goodwin | 383/10 |
| 3,568,576 | 3/1971 | Lehmacher et al. | 383/10 |

FOREIGN PATENT DOCUMENTS

| | | | |
|---|---|---|---|
| 0293995 | 12/1988 | European Pat. Off. | 383/10 |
| 1498629 | 10/1967 | France | 383/10 |
| 1315262 | 5/1973 | United Kingdom | 383/10 |

*Primary Examiner*—Stephen Marcus
*Assistant Examiner*—Nova Stucker
*Attorney, Agent, or Firm*—Cushman, Darby & Cushman

[57] ABSTRACT

A carrier bag or similar bag-like pack made from a plastic film or a similar material, with a carry handle provided on a narrow panel, which is formed by two oblong openings positioned a certain distance apart, between which a strip of material with the function of a carry handle is located. At least the area of the openings of this narrow panel has a backing panel on the inside.

2 Claims, 1 Drawing Sheet

CARRIER BAG

The invention relates to a carrier bag or a similar bag-like pack made from a plastic film or a similar material, with a carry handle provided on one of the narrow panels.

Numerous carrier bags of this kind have been disclosed with carry handles sealed to the walls of the carrier bag. Display area is lost on the walls as a result, which is not desirable.

The purpose of the invention is therefore to create a carrier bag of the kind outlined above, with a carry handle that is attached without affecting the side panels.

In the solution to this problem proposed by the invention, two oblong openings a certain distance apart are provided on the narrow panel concerned, between which a strip of material of the narrow panel with the function of a carry handle is located. At least the area of the openings in the narrow panel has a backing panel on the inside, the edges of which are sealed to the narrow panel.

Not only are the side panels completely unaffected by the carry handle as a result; the narrow panel is also available for use as an additional display area. The production of such a carrier bag and in particular the design of the carry handle are very simple as well.

In an advantageous further development of the invention, the narrow panel has a reinforcement layer in the area of the carry handle.

This means that the narrow panel can be relatively thin, with no danger that the bag will tear open.

It can be particularly advantageous here if in accordance with the invention, the reinforcement layer also extends beyond the area of the openings and is provided with appropriate openings itself.

If the reinforcement layer is provided between the narrow panel and the backing panel located on the inside, as is the case in a further embodiment of the invention, this is a particularly effective arrangement that does not have an adverse effect on the printability of the narrow panel.

It is very advantageous here if in accordance with the invention, at least sections of the reinforcement layer are sealed to the narrow panel.

This makes sure that the reinforcement layer does not slip unintentionally.

Figure 1:
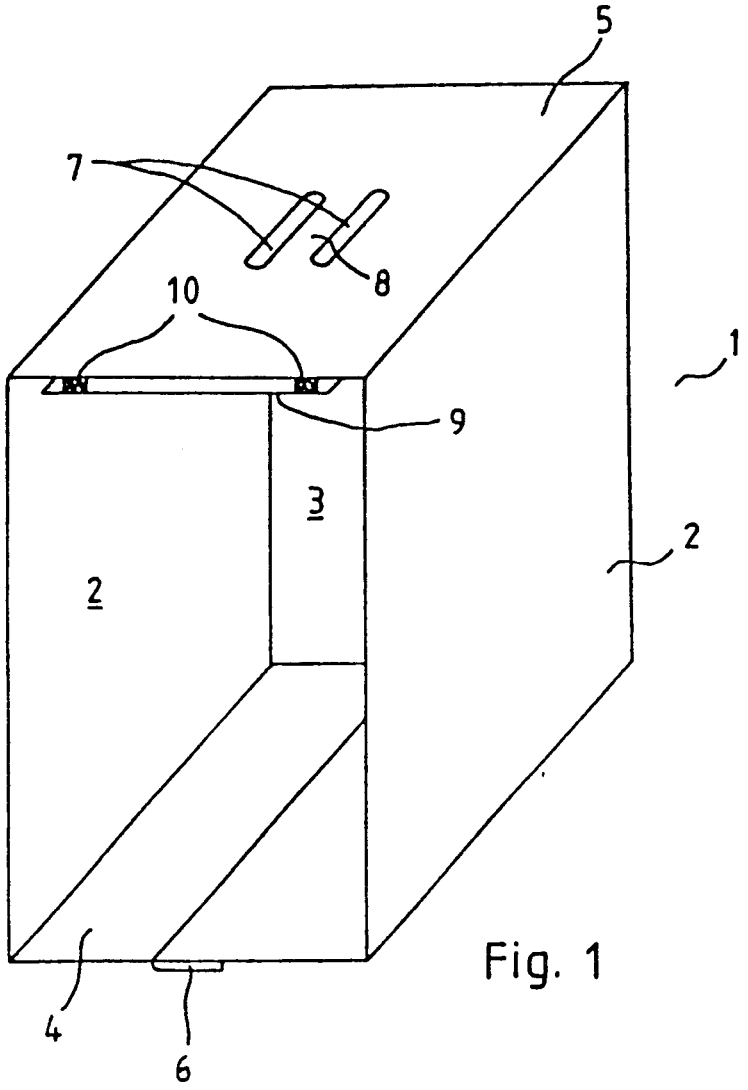
Figure 2:
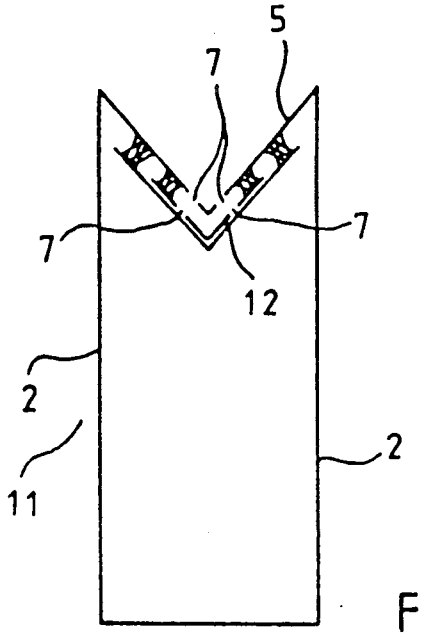

The drawings show two embodiments of the invention:

FIG. 1 shows a bag-like pack with hand holes in the narrow top panel and with a backing panel on the inside and FIG. 2 is a section through a bag-like pack with an additional reinforcement layer between the narrow top panel and the backing panel.

FIG. 1 shows a bag-like pack 1 which has two side panels 2, two end panels 3, a base 4 and a narrow top panel 5. The pack 1 is closed on the base by a seam 6 that is folded over and sealed. The narrow top panel 5 is provided with two hand holes 7, between which a strip of material 8 is located which acts as a carry handle. A backing panel 9 is provided on the side of the narrow panel 5, the front end panel being removed in FIG. 1 to make this visible. The backing panel 9 is attached to the narrow top panel 5 by two sealed seams 10.

FIG. 2 shows an embodiment in which the pack 11 is only folded out partially. One end panel has again been removed in the drawing, so that the internal structure is visible. A reinforcement layer 12, which is also provided with openings 7 as hand holes, is sealed to the inside of the narrow top panel 5 in addition to the backing panel 9.

We claim:

1. A carrier bag pack made from a film, said pack including a base, a pair of side panels, each of the side panels extending from said base, a pair of end panels, and a narrow top panel connected to each of the side panels, said narrow top panel having two oblong openings extending parallel to each other and to a long side of the narrow top panel, each oblong opening having a first radiused end and a second radiused end joined by two generally parallel sides to form an outer perimeter of the oblong opening, the entire outer perimeter of each oblong opening being perforated through the narrow top panel, said oblong openings spaced a selected distance apart with a strip of material therebetween so as to define a carry handle, a backing panel being provided on an interior side of said narrow top panel so as to underlie said oblong openings, said backing panel being directly sealed to said narrow top panel and being unattached to said side panels, a reinforcement panel being provided between said backing panel and said narrow top panel, said reinforcement panel extending beyond the area of said narrow top panel oblong holes, said reinforcement panel also having two oblong openings with a strip therebetween, said two reinforcement panel oblong openings being aligned with said two narrow top panel oblong openings to provide a two layer carry handle, said reinforcement panel being directly sealed to said narrow top panel and being unattached to said side panels.

2. A carrier bag according to claim 1, wherein the film is plastic.

* * * * *